US006722165B2

(12) United States Patent
Woo et al.

(10) Patent No.: US 6,722,165 B2
(45) Date of Patent: Apr. 20, 2004

(54) WASHING MACHINE HAVING DRYING FUNCTION

(75) Inventors: Kyung Chul Woo, Seoul (KR); In Chul Jeong, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/107,347

(22) Filed: Mar. 28, 2002

(65) Prior Publication Data

US 2003/0051515 A1 Mar. 20, 2003

(30) Foreign Application Priority Data

Dec. 5, 2001 (KR) ..... 2001-76685

(51) Int. Cl.[7] ..... D06F 25/00
(52) U.S. Cl. ..... 68/19.2; 68/20; 34/77
(58) Field of Search ..... 68/19.2, 20, 23 R; 34/77, 82, 131, 596, 601, 604, 605, 607–610

(56) References Cited

U.S. PATENT DOCUMENTS 2,607,209 A * 8/1952 Constantine ..... 68/20
2,651,113 A * 9/1953 Milby et al.
2,680,917 A * 6/1954 Finley
3,113,445 A * 12/1963 Williams et al.
3,190,011 A * 6/1965 Shields ..... 34/607 X
3,734,688 A * 5/1973 Fairneny
3,866,333 A * 2/1975 Surakahanian et al. ..... 34/77 X
4,498,317 A * 2/1985 Thysen et al. ..... 68/20 X
4,903,508 A * 2/1990 Durazzani et al.
5,146,693 A * 9/1992 Dottor et al. ..... 34/77
5,802,884 A * 9/1998 Cavalli ..... 68/20 X
5,983,520 A * 11/1999 Kim et al.
6,282,928 B1 * 9/2001 Fukumoto et al. ..... 68/20
2001/0015082 A1 * 8/2001 Minayoshi et al.

FOREIGN PATENT DOCUMENTS

| | | | |
|---|---|---|---|
| FR | 2623531 | * 3/1989 | |
| GB | 2044297 | * 10/1980 | ..... 68/20 |
| GB | 2181220 | * 4/1987 | |
| GB | 2215826 | * 9/1989 | |
| JP | 2-249584 | * 10/1990 | |
| JP | 2001-29687 | * 2/2001 | |

OTHER PUBLICATIONS

European Patent Application 221,584 May 1987.*

* cited by examiner

*Primary Examiner*—Frankie L. Stinson
(74) *Attorney, Agent, or Firm*—Birch, Stewart, Kolasch & Birch, LLP

(57) ABSTRACT

The present invention relates to a washing machine having a drying function, and more particularly, to a washing machine having a drying function, in which structures of a circulation duct and a fan/motor assembly are improved for improving a drying function and a productivity of the washing machine having a drying function. The present invention includes an outside case, an outer tub inside of the outside case for storage of washing water, an inner tub inside of the outer tub, a re-circulation duct connected between one side of a lower part of the outer tub and a top of the outer tub for providing a re-circulation passage of air in the inner tub, a fan/motor assembly fitted to the re-circulation duct with a motor shaft positioned horizontal, for blowing the air, and a heater fitted downstream of the fan/motor assembly on the re-circulation duct, for heating the circulating air.

20 Claims, 5 Drawing Sheets

WASHING MACHINE HAVING DRYING FUNCTION

BACKGROUND OF THE INVENTION

1. Field of the Invention

The present invention relates to a washing machine having a drying function, and more particularly, to a washing machine having a drying function, in which structures of a circulation duct and a fan/motor assembly are improved for improving a drying function and a productivity of the washing machine having a drying function.

2. Background of the Related Art

A pulsator type washing machine washes laundry by water circulation occurred by forced circulation of washing water supplied to the washing machine, friction caused by the water circulation, softening action of detergent, and the like, by a washing process inclusive of, in general, washing, rinsing, spinning, and water supply/discharge cycles.

In the meantime, there are drum type washing machines in which the laundry is dropped by rotating a drum to give impact to the laundry for washing the laundry.

The foregoing washing machines only have in general a washing function for washing clothes and the like, to require the laundry taken out of the washing machine after the washing and spread in, or outside of a room for drying.

However, since a general dryer has a size almost similar to the washing machine, separate installation of the washing machine and the dryer occupy a large space, and troublesome and inconvenient because the laundry having the washing finished is required to be taken out of the washing machine and put into the dryer, again.

Consequently, development of a washing machine having a drying function in addition to a washing function has been in need, and, as a result, a pulsator type washing machine having a drying function has been developed. An exemplary overall structure of a related art pulsator type washing machine having a drying function will be explained with reference to FIG. 1. At first, components for the washing function for washing laundry will be explained.

There are an outer tub 3 for storage of washing water inside of an outside case 1, an inner tub 4 rotatably mounted inside of the outer tub 3 having a plurality of through holes 4*a* formed therein, and a pulsator 5 rotatably fitted inside of the inner tub 4. The inner tub 4 and the pulsator 5 are rotated by a driving source 6 fitted to an underside of the outer tub 3.

There are a water supply valve 7 fitted in an upper part of the outer case 1 for supplying water required for washing and rinsing, and a water supply duct 7*a* connected to the water supply valve 7 for supplying water to the inner tub 4.

There are a drain hose 8 fitted to an underside of the outer tub 3 for draining dirty washing water after the washing is completed to outside of the washing machine, and a drain valve 9 on the drain hose 8. Unexplained reference symbol 2 denotes a top cover.

Next, components for drying laundry will be explained.

There is a fore end of a re-circulation duct 10 in the inner tub 4 for supplying heated air to the laundry for drying the laundry. In more detail, the re-circulation duct 10 has a structure in which the heated air is, not discharged to outside of the washing machine as it is, but re-circulated to the inner tub 4 again after the heated air makes heat exchange with the laundry, and which is fitted to connect one side of a lower part of the outer tub 3 and an opened upper side of the inner tub for supplying the heated air to the inner tub for drying laundry in the inner tub 4. Of course, there are a heater 11 on the re-circulation duct 10 for heating air, and a fan 12 for forced circulation of air. The fan 12 is a sirocco fan.

In the meantime, there is an open/closeable inner cover 3*a* closely fitted to top of the inner tub 4 for prevention of air leakage, and the fore end of the re-circulation duct 10 is connected to the inner cover 3*a*.

The operation of the washing machine will be explained. At first, the washing function will be explained.

The washing function is substantially the same with other related art washing machine. That is, by carrying out washing, rinsing, spinning cycles in succession, the washing of the laundry is done.

Upon completion of the washing and spinning cycles, a drying cycle is started. Once the drying cycle is started, the heater 11 and the fan 12 are put into operation, to supply high temperature dry air to an inside of the inner tub. The high temperature dry air supplied to the inner tub 4 takes moisture contained in laundry, to dry the laundry, and is turned into high temperature humid air.

The high temperature humid air escapes through the re-circulation duct 10 connected to the outer tub, and is supplied to the inner tub 4 again through the fan 12 and the heater 11.

During the foregoing process, water supply means 16 fitted to the re-circulation duct 10 flows cold water inside of the re-circulation duct 10, for removing the moisture contained in the high temperature and high humid air escaped from the outer tub at the re-circulation duct 10 before the high temperature and high humid air is introduced into the fan 12 and the heater 11.

In detail, the water supply means 16 is provided with a cold water inlet in the re-circulation duct 10, and a water supply valve fitted to the water supply tube connected to the cold water inlet.

In the meantime, the low temperature and low humid air having the moisture removed therefrom is heated by the heater 11 again, into a high temperature dry air, and supplied to the inner tub 4 by blowing of the fan 12.

In short, by repeating a series of process for supplying heated dry air inside of the inner tub 4, to absorb moisture in the laundry, removing the moisture by re-circulating the air through the re-circulation duct 10, re-heating the air at the heater 11, and supplying the air into an inside of the inner tub again, the laundry in the inner tub 4 becomes the drier gradually, to complete the drying cycle when the laundry is dried completely as the series of process is repeated for a required time period.

However, the related art washing machine having a drying function has the following disadvantages.

As shown in FIG. 3, the related art washing machine having a drying function has the fan 12 fitted to top of the washing machine independently, together with the heater 11, which inhibits enlargement of an outside diameter of the fan due to interference with the outside case and the top cover, that limits the drying performance because of a low air blowing rate.

Particularly, because the vertical shaft which connects the motor 13 and the fan 12 requires a height 'h' of projection from a top part of the washing machine having a drying function for securing a certain amount of space to accommodate the fan 12 and the heater 11, a total height 'H' of the washing machine is increased, that causes an outside view of the washing machine poor.

That is, the projection from a top part of the related art washing machine having a drying function provided to avoid interference between the vertical shaft connecting the motor 13 and the fan 12 and various components, such as the water supply valve, and the like, in the upper part of rear of the top cover causes the foregoing disadvantage.

SUMMARY OF THE INVENTION

Accordingly, the present invention is directed to a washing machine having a drying function that substantially obviates one or more of the problems due to limitations and disadvantages of the related art.

An object of the present invention is to provide a washing machine having a drying function, in which a fan with an increased air blow rate is fitted to a re-circulation duct without change of a total height of the washing machine for improving a drying performance of the washing machine having a drying function.

Another object of the present invention is to provide a washing machine having a drying function, in which a fan with an increased air blow rate is fitted to a re-circulation duct without change of a total height of the washing machine, and with an improved assembling for improving a drying performance and a productivity of the washing machine having a drying function.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the washing machine having a drying function includes an outside case, an outer tub inside of the outside case for storage of washing water, an inner tub inside of the outer tub, a re-circulation duct connected between one side of a lower part of the outer tub and top of the outer tub for providing a re-circulation passage of air in the inner tub, a heater fitted to a downstream of the fan/motor assembly on the re-circulation duct, for heating the circulating air, and a fan/motor assembly fitted to the re-circulation duct with a motor shaft positioned horizontal, for blowing the air toward the heater.

In another aspect of the present invention, there is provided a washing machine having a drying function including an outside case, an outer tub inside of the outside case for storage of washing water, an inner tub inside of the outer tub, a re-circulation duct connected between one side of a lower part of the outer tub and top of the outer tub for providing a re-circulation passage of air in the inner tub, a heater fitted to a downstream of the fan/motor assembly on the re-circulation duct, for heating the circulating air, and a fan/motor assembly fitted to the re-circulation duct with a motor shaft positioned horizontal to form a flow passage along with the re-circulation duct, for blowing the air toward the heater.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
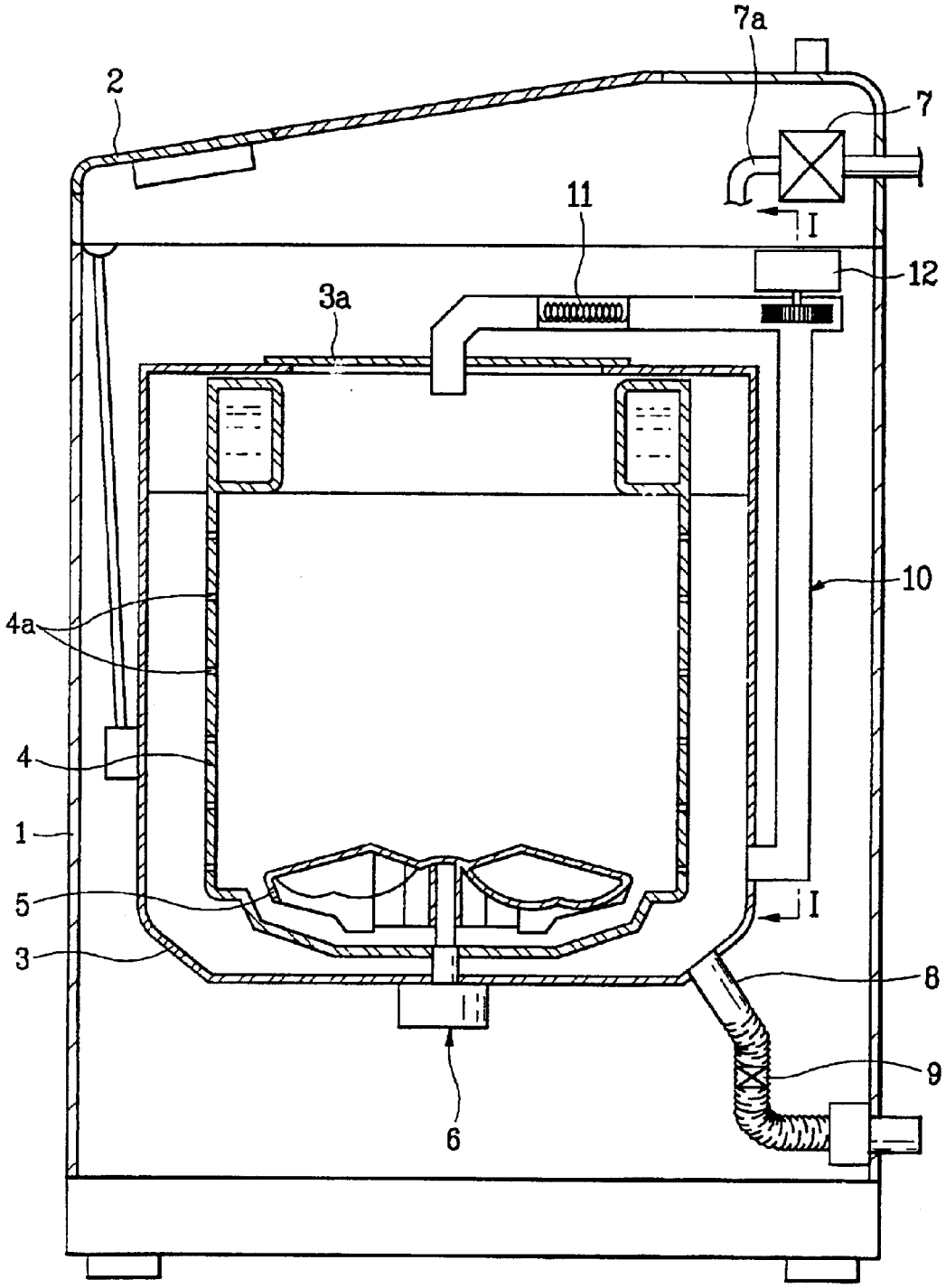
FIG.1 Related Art
FIG. 1 illustrates a section of a related art washing machine having a drying function, schematically.
Figure 2:
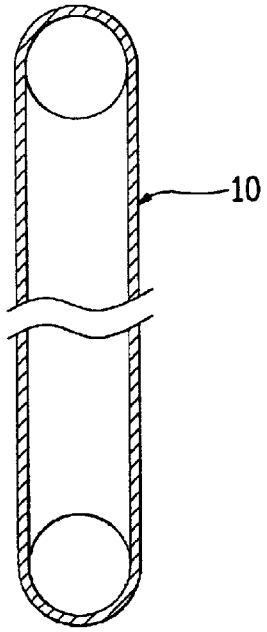
FIG.2 Related Art
FIG. 2 illustrates a section across a line I—I in FIG. 1.
Figure 3:
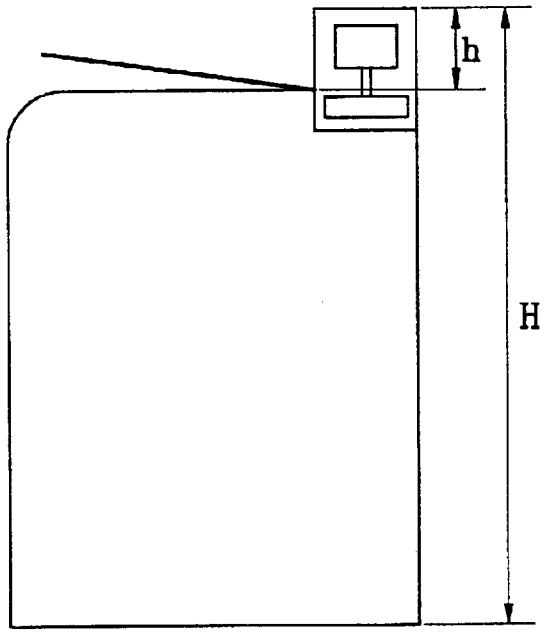
FIG.3 Related Art
FIG. 3 illustrates a disadvantage of a related art washing machine having a drying function, schematically.
Figure 4:
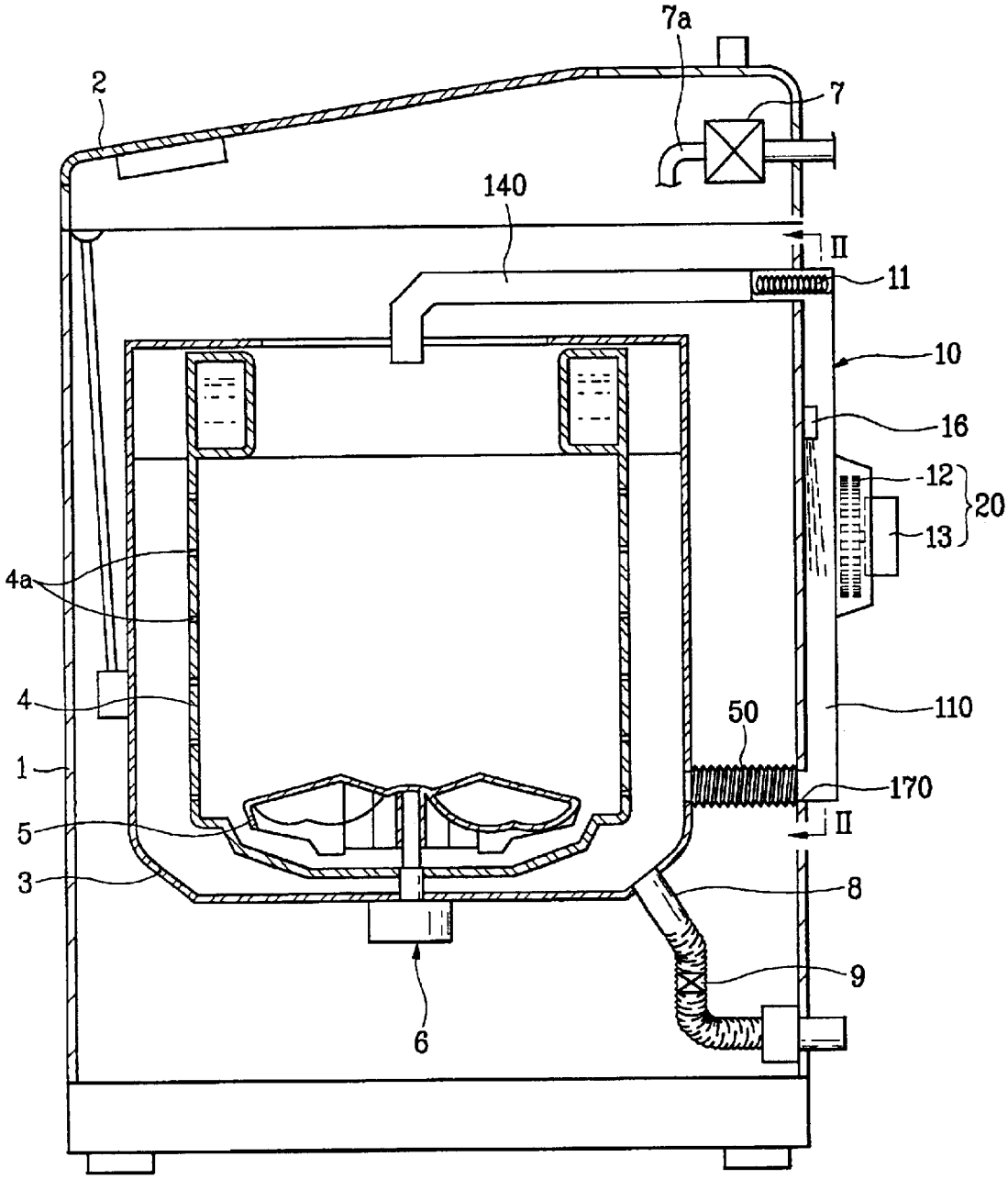
FIG. 4 illustrates a section of a washing machine having a drying function in accordance with a preferred embodiment of the present invention, schematically.
Figure 5:
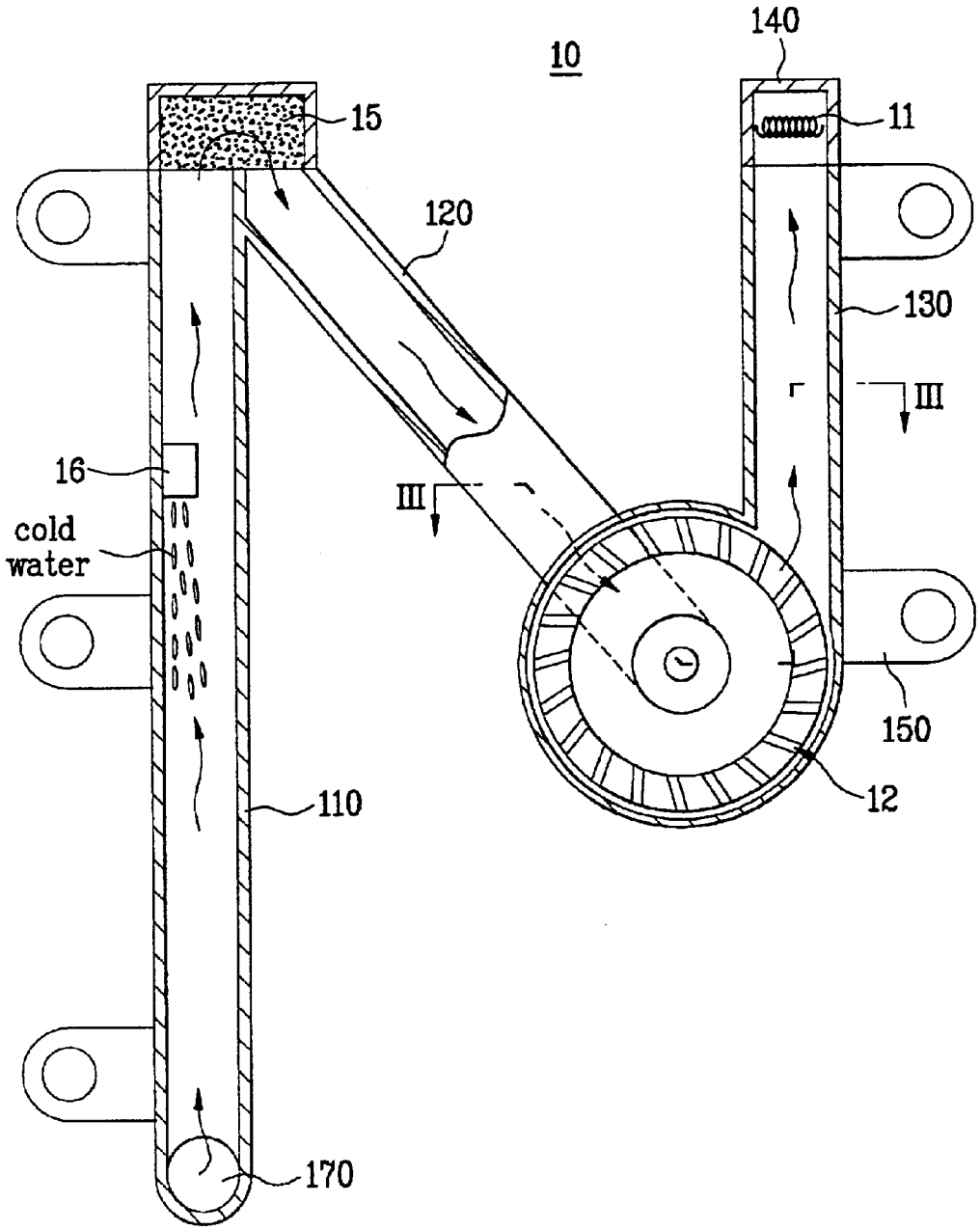
FIG. 5 illustrates a section across a line II—II in FIG. 4.
Figure 6:
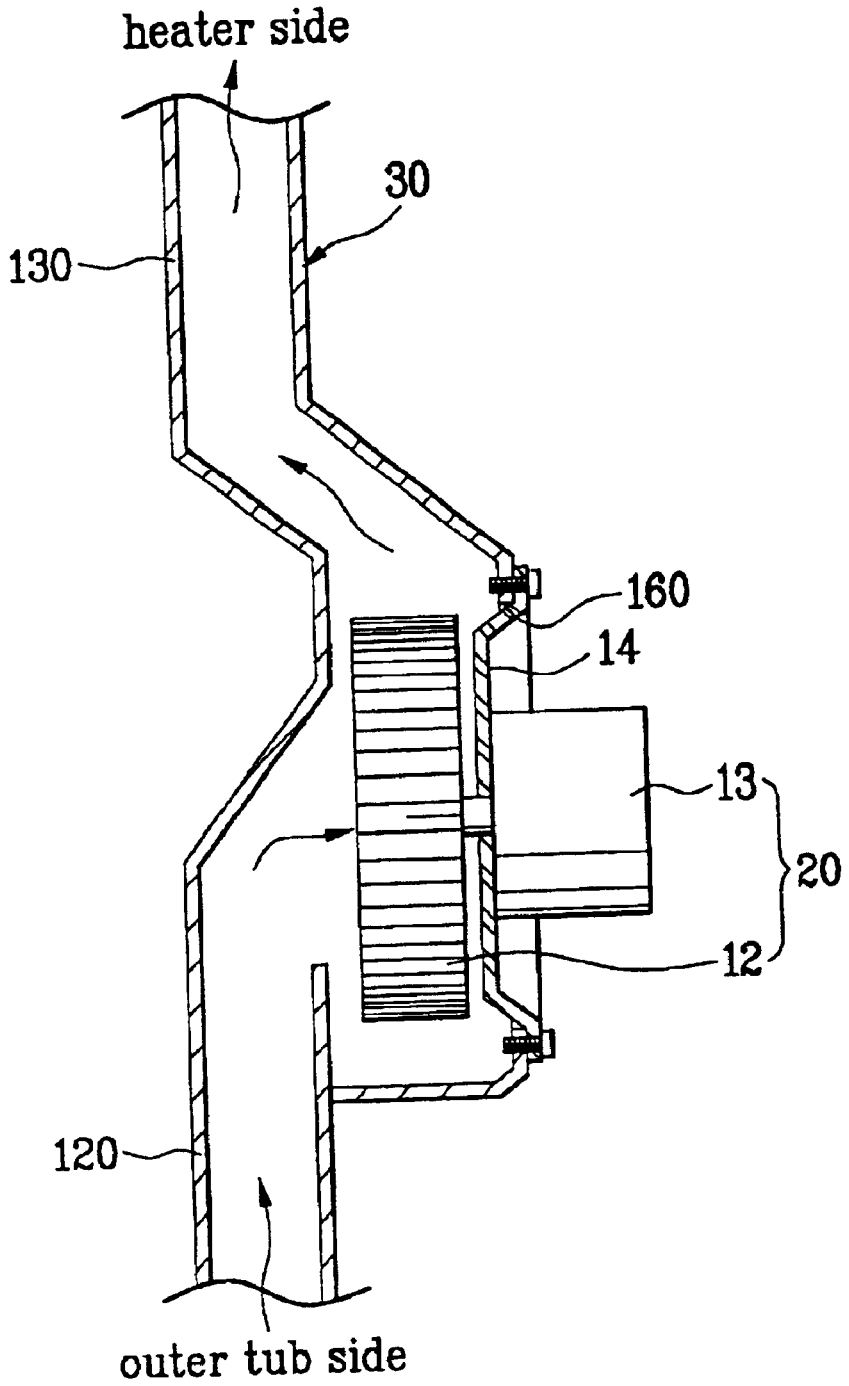
FIG. 6 illustrates a section across a line IIII–III in FIG. 5, showing an assembly of a re-circulation duct and a fan/motor.

Reference will now be made in detail to the preferred embodiments of the present invention, examples of which are illustrated in the accompanying drawings. FIG. 4 illustrates a section of a washing machine having a drying function in accordance with a preferred embodiment of the present invention schematically, FIG. 5 illustrates a section across a line II—II in FIG. 4, and FIG. 6 illustrates a section across a line IIII–III in FIG. 5, showing an assembly of a re-circulation duct and a fan/motor.

The washing machine in accordance with a preferred embodiment of the present invention includes an outside case 1, an outer tub 3 inside of the outside case 1 for storage of washing water, an inner tub 4 inside of the outer tub, a re-circulation duct 10 connected between one side of a lower part of the outer tub 3 and top of the outer tub 3 for providing a re-circulation passage of air in the inner tub, a heater 11 fitted to a downstream of the fan/motor assembly 20 on the re-circulation duct 10, for heating the circulating air, and the fan/motor assembly 20 fitted to the re-circulation duct 10 with a motor shaft positioned horizontal to form a flow passage along with the re-circulation duct 10, for blowing the air toward the heater 11.

The re-circulation duct 10 includes a humid air discharge tube 50 connected between one side of a lower part of the outer tub 3 and a re-circulation outlet 170 at one side of the outside case 1, a duct assembly 30 connected to the re-circulation outlet 170 and fitted to outside of the outside case, and a hot air supply tube 140 connected in substantially horizontal direction from the duct assembly 30 to position an outlet thereof on top of the outer tub.

The duct assembly 30 includes a first duct part 110 connected to the re-circulation outlet 170 in one side of the outside case 1 to run upward, a second duct part 120 connected to top end of the first duct part 110 to run downward, and a third duct part 130 connected to a bottom end of the second duct part 120 to run upward again.

In the meantime, a part at which the second duct part 120 and the third duct part 130 of the duct assembly 30 are connected is positioned above a center of the outside case 1 in view of height, where a fan/motor assembly 20 is fitted. The part at which the second duct part 120 and the third duct part 130 of the duct assembly 30 are connected has a through hole 160 to be closed when the fan/motor assembly 20 is assembled.

The fan/motor assembly 20 includes a motor 13 fitted to outside of the duct assembly 30, a fan 12 fitted to an inside of the duct assembly 30 and connected with the motor 13 by a shaft, and a motor guide 14 having the motor 13 fixed thereto fitted to close the through hole 160 of the duct assembly 30. The through hole 160 in the duct assembly 30 or the motor guide 14 may have a scroll form, and it is preferable that the fan 12 is a sirocco fan.

There are a filter 15 at a joint of the second duct part 120 and the third duct part 130 of the duct assembly 30, and water supply means 16 in the first duct part 110 of the duct assembly 10 for supplying cooling water in tube passage for condensing humid air flowing toward the fan.

Alike the related art, the water supply means 16 includes a cold water inlet formed in the first duct part 110, and a water supply valve on the water supply passage connected to the cold water inlet.

The humid air discharge tube 50 connected between one side of a lower part of the outer tub 3 and the re-circulation outlet 170 in one side of the outside case 1 is formed of a bellows hose for preventing damage from movement of the outer tub.

The duct assembly 30 has a plurality of fastening guides 150 fitted thereto, and the outside case has fastening devices (not shown) for coupling the fastening guides 150 thereto at outside thereof for fixing the duct assembly 30 as the fastening guides 150 are coupled to the fastening devices.

The operation of the washing machine having a drying function of the present invention will be explained. At first, the washing function will be explained.

The washing function is the same with the related art washing machine, actually. That is, the washing, rinsing, spinning cycles are carried out in succession to make the washing done.

In the meantime, upon completion of the washing and spinning cycles, the drying cycle is started, when the heater 11 and the fan 12 are put into operation, to blow high temperature dry air into the inner tub. The high temperature dry air blown into the inner tub takes moisture in the laundry, to dry the laundry, and is turned into a high temperature humid air. The high temperature humid air escapes through the re-circulation duct 10 connected to the outer tub, and supplied to the inner tub 4 again through the fan 12 and the heater 11.

The present invention is identical to the related art in that the dry of the laundry is done by making continuous preset time period repetition of a series of process for supplying heated dry air inside of the inner tub 4, to absorb moist in the laundry, removing the moisture by re-circulating the air through the duct assembly 10, re-heating the air at the heater 11, and supplying the air into an inside of the inner tub again.

However, a detailed air flow process is different from the related art because of the different structures of the air re-circulation duct 10, and the fan/motor assembly 20 fitted thereto. That is, when the drying cycle is started, the heater 11 and the fan 12 are put into operation, to supply high temperature dry air to an inside of the inner tub 4, so that the high temperature dry air takes moist moisture in the laundry, to dry the laundry, is turned to high temperature humid air, escapes through the re-circulation outlet 170 in a lower part of the outside case through the humid air discharge tube 50 connected to a lower part of the outer tub. Then, the high temperature humid air escaped through the re-circulation outlet 170 in a lower part of the outside case rises along the first duct part 110 in the duct assembly 30.

In this instance, the cold water coming out of the cold water inlet in the first duct part 110 condenses the moisture in the high temperature humid air rising along the first duct part 110, thereby removing the moisture. That is, the water condensed at the first duct part 110 flows down by gravity and is drained off through the drain hose 8 connected to the outer tub 3.

Then, the air turned into a lower temperature humid state passes through the filter 15 at a top end of the first duct part 110, when airborne foreign matter, such as nap, is removed at the filter 15. Then, the air passed through the filter 15 flows down along the second duct part 120, enters into the fan 12 in an axial direction, and escapes therefrom in a centrifugal direction by an action of the fan 12.

In the meantime, the third duct part 130 is fitted to an outlet side of the fan 12, so that the air escaped from the fan 12 rises along the third duct part 130, and flows therefrom in a horizontal direction along the hot air supply tube 140, and enters into the inner tub again.

In this instance, the heater 11 fitted in the hot air supply tube 140, or between the third duct part 130 and the hot air supply tube 140 heats the low temperature humid air, to high temperature dry air.

In the meantime, during the drying cycle, it is preferable that the pulsator rotates to turn over the laundry in the inner tub 4 appropriately, for uniform dry of the laundry.

The fan/motor assembly 20 fitted in the middle of the duct assembly 30 in rear of outside of the outside case provides improvement in the washing performance and assembling to the washing machine having a drying function of the present invention in which the drying is done according to the foregoing drying cycle, as follows.

First, the fitting of the duct assembly 30 in rear of outside of the outside case where a space for fitting the fan/motor assembly 20 is adequate, and the fitting of the fan/motor in the middle of the duct assembly 30 permits a significant increase of a diameter of the fan 12, with an increase of air blowing rate, that improves the drying performance, substantially.

Next, the productivity is improved because the fan/motor assembly 20, assembled in advance separately in a state the duct assembly 30 is assembled to the outside case at first, may be assembled to the duct assembly 30 fixed to the outside case, or the duct assembly 30 and the fan/motor assembly 20 are assembled at first, and the duct assembly 30 having the fan/motor assembly 20 assembled thereto may be fixed to the outside case later, that provides a flexibility in the assembly.

When the fan/motor assembly 20 is assembled to the duct assembly 30, the motor guide 14 in the fan/motor assembly 20 closes the through hole 160 in the duct assembly 30. Thus, the motor guide 14 serves as a fastening member for fastening the motor 13 to the duct assembly 30 as well as a part of the duct assembly 30 that closes the through hole 160 in the duct assembly 30.

In the meantime, the duct assembly 30 is fixed as the fastening guides 150 are coupled to fastening devices on the outside case, which is also possible even in a case the fan/motor assembly 20 is assembled to the duct assembly 30 in advance.

Though the foregoing embodiment of the present invention describes a structure, as an example, in which the duct assembly 30 has a through hole 160, and the through hole 160 is closed by the motor guide 14 in the fan/motor assembly 20 as the fan/motor assembly 20 is assembled to the duct assembly 30, of course, the present invention is not limited to this.

That is, it is not invariably required that the through hole 160 is formed in the duct assembly 30 for fitting the fan/motor assembly 20, and, as far as there is an access opening for fastening the fan/motor assembly 20 to the duct assembly 30, it is not necessarily required that the motor guide 14 in the fan/motor assembly forms a part of the flow passage.

It will be apparent to those skilled in the art that various modifications and variations can be made in the washing machine having a drying function of the present invention without departing from the spirit or scope of the invention. Thus, it is intended that the present invention cover the modifications and variations of this invention provided they come within the scope of the appended claims and their equivalents.

As has been explained, the present invention relates to a full automatic washing machine having a drying function, and more particularly, to a washing machine having a drying function, in which structures of a circulation duct and a fan/motor assembly are improved for improving a drying function and a productivity of the washing machine having a drying function.

That is, the washing machine having a drying function of the present invention improves the drying function of the washing machine having a drying function by improving the structures of the re-circulation duct and the fan/motor assembly, to permit an increase of a diameter of the fan fitted to the re-circulation duct without any change of a total height of the washing machine, that increase an air blow rate.

Moreover, the washing machine having a drying function of the present invention having a fan with an increased air blow rate is fitted to a re-circulation duct without change of a total height of the washing machine, and an improved assembling improves a drying performance and a productivity of the washing machine having a drying function.

What is claimed is:

1. A washing machine having a drying function, comprising:

an outside case;

an outer tub inside of the outside case for storage of washing water;

an inner tub inside of the outer tub;

a re-circulation duct connected between a re-circulation outlet at a lower part of the outer tub and a re-circulation at a top of the outer tub for providing a re-circulation passage of air in the inner tub, the re-circulation duct including:

a first duct part connected to the re-circulation outlet to run upward;

a second duct part connected to a top end of the first duct part to run downward; and a third duct part connected to a bottom end of the second duct part to run upward to the re-circulation inlet;

a fan/motor assembly fitted to the re-circulation duct, for blowing the air; and a heater fitted on the re-circulation duct, for heating the circulating air.

2. A washing machine as claimed in claim 1, wherein the fan/motor assembly is located at a junction between the second joint part and the third joint part, with a motor shaft positioned horizontal.

3. A washing machine as claimed in claim 1, wherein the heater is located downstream of the fan/motor assembly.

4. A washing machine having a drying function, comprising:

an outside case;

an outer tub inside of the outside case for storage of washing water;

an inner tub inside of the outer tub;

a re-circulation duct connected between one side of a lower part of the outer tub and a top of the outer tub for providing a re-circulation passage of air in the inner tub;

a fan/motor assembly fitted to the re-circulation duct with a motor shaft positioned horizontal, for blowing the air; and a heater fitted downstream of the fan/motor assembly on the re-circulation duct, for heating the circulating air, wherein the re-circulation duct includes;

a humid air discharge tube connected between one side of a lower part of the outer tub and a re-circulation outlet at one side of the outside case;

a duct assembly connected to the re-circulation outlet and fitted outside of the outside case; and a hot air supply tube connected in a substantially horizontal direction from the duct assembly to position an outlet thereof on top of the outer tub, wherein the duct assembly includes:

a first duct part connected to the re-circulation outlet in one side of the outside case to run upward;

a second duct part connected to top end of the first duct part to run downward; and a third duct part connected to a bottom end of the second duct part to run upward again.

5. A washing machine as claimed in claim 4, wherein a part the second duct part and the third duct part joint in the duct assembly is positioned above a center of the outside case in a height direction.

6. A washing machine as claimed in claim 4, wherein the fan/motor assembly is fitted to the part the second duct part and the third duct part joint.

7. A washing machine as claimed in claim 6, wherein the fan/motor assembly includes:

a motor fitted to an outside of the duct assembly; and a fan fitted to an inside of the duct assembly, and connected with the motor by a shaft.

8. A washing machine as claimed in claim 4, wherein the duct assembly has a filter between the first duct part and the second duct part.

9. A washing machine as claimed in claim 4, further comprising water supply means in the first duct part for supplying cold water.

10. A washing machine as claimed in claim 4, wherein the humid air discharge tube is formed of bellows hose.

11. A washing machine having a drying function, comprising:

an outside case;

an outer tub inside of the outside case for storage of washing water;

an inner tub inside of the outer tub;

a re-circulation duct connected between a re-circulation outlet at a lower part of the outer tub and a re-circulation at a top of the outer tub for providing a re-circulation passage of air in the inner tub, with a portion of the re-circulation duct being fitted outside of the outside case, the re-circulation duct including:

a first duct part connected to the re-circulation outlet to run upward;

a second duct part connected to a top end of the first duct part to run downward; and a third duct part connected to a bottom end of the second duct part to run upward to the re-circulation inlet;

a fan/motor assembly fitted to the re-circulation duct with a motor shaft positioned horizontal to form a flow passage along with the re-circulation duct, for blowing the air; and a heater fitted downstream of the fan/motor assembly on the re-circulation duct, for heating the circulating air.

12. A washing machine having a drying function comprising:

an outside case;

an outer tub inside of the outside case for storage of washing water;

an inner tub inside of the outer tub;

a re-circulation duct connected between one side of a lower part of the outer tub and a top of the outer tub for providing a re-circulation passage of air in the inner tub;

a fan/motor assembly fitted to the re-circulation duct with a motor shaft positioned horizontal to form a flow passage along with the re-circulation duct, for blowing the air; and a heater fitted downstream of the fan/motor assembly on the re-circulation duct, for heating the circulating air, wherein the duct assembly includes:

a humid air discharge tube connected between one side of a lower part of the outer tub and a re-circulation outlet at one side of the outside case;

a duct assembly connected to the re-circulation outlet and fitted outside of the outside case; and a hot air supply tube connected in substantially horizontal direction from the duct assembly to position an outlet thereof on top of the outer tub, wherein the duct assembly includes:

a first duct part connected to the re-circulation outlet in one side of the outside case to run upward;

a second duct part connected to top end of the first duct part to run downward; and a third duct part connected to a bottom end of the second duct part to run upward again.

13. A washing machine as claimed in claim 12, wherein a part the second duct part and the third duct part joint in the duct assembly is positioned above a center of the outside case in a height direction.

14. A washing machine as claimed in claim 13, wherein the fan/motor assembly is fitted to the part the second duct part and the third duct part joint.

15. A washing machine as claimed in claim 14, wherein the part the second duct part and the third duct part in the duct assembly joint includes a through hole to be closed when the fan/motor assembly is assembled.

16. A washing machine as claimed in claim 15, wherein the fan/motor assembly includes:

a motor fitted to an outside of the duct assembly;

a fan fitted to an inside of the duct assembly, and connected with the motor by a shaft; and a motor guide having the motor fixed thereto fitted to close the through hole.

17. A washing machine as claimed in claim 12, wherein the duct assembly has a filter between the first duct part and the second duct part.

18. A washing machine as claimed in claim 12, further comprising water supply means in the first duct part for supplying cold water.

19. A washing machine as claimed in claim 12, wherein the humid air discharge tube is formed of bellows hose.

20. A washing machine as claimed in claim 12, wherein the duct assembly has a plurality of fastening guides fitted thereto, and the outside case has fastening devices for coupling the fastening guides thereto at an outside thereof for fixing the duct assembly as the fastening guides are coupled to the fastening devices.

* * * * *